United States Patent [19]

Sherwood et al.

[11] 4,303,960

[45] Dec. 1, 1981

[54] ELECTROSTATIC DISCHARGE-PROTECTED SWITCH

[75] Inventors: Robert A. Sherwood; Svein T. Nordberg, both of El Paso, Tex.

[73] Assignee: GTE Products Corporation, El Paso, Tex.

[21] Appl. No.: 109,423

[22] Filed: Dec. 31, 1979

[51] Int. Cl.[3] ..... H05F 3/02

[52] U.S. Cl. ..... 361/212; 361/220; 200/305

[58] Field of Search ..... 361/212, 220; 200/305, 200/DIG. 1

[56] References Cited

U.S. PATENT DOCUMENTS

| | | | |
|---|---|---|---|
| 3,887,848 | 6/1975 | Larson et al. | 200/DIG. 1 |
| 4,040,120 | 8/1977 | Geadah et al. | 361/220 |
| 4,041,300 | 8/1977 | Blount | 361/212 X |
| 4,211,324 | 7/1980 | Ohlbach | 361/212 X |

OTHER PUBLICATIONS

"Prevention of Static Discharge in Display Tubes", Rowe, R. L., *IBM Tech. Disclosure Bulletin,* vol. 20, No. 12, May 1978.

*Primary Examiner*—J. D. Miller

*Assistant Examiner*—L. C. Schroeder

*Attorney, Agent, or Firm*—Russell A. Cannon

[57] ABSTRACT

A tactile matrix switch has a planar electrically conductive layer dielectrically spaced between contacts of individual switch elements and an actuating mechanism such as a finger on the body of a human being who may carry an electrostatic charge. Some switch contacts are electrically connected through external circuitry to ground. The conductive layer is also electrically connected to ground. When a human operator carrying an electrostatic charge brings his finger near the face of the matrix switch for applying a tactile force to actuate an individual switch element, the conductive layer electrically conducts the electrostatic charge to ground and away from the switch contacts for protecting the electrical circuitry connected to the latter. In one embodiment, the conductive layer is electrically conductive printer's ink, having a resistivity of less than 50 k ohms per square, that is silk screened onto the back of a face plate of the matrix switch. In an alternate embodiment, the conductive layer is printed onto the same broad side of a flexible dielectric plate to which the tactile force is applied, switch contacts being formed on the opposite broad side thereof.

6 Claims, 6 Drawing Figures

ELECTROSTATIC DISCHARGE-PROTECTED SWITCH

BACKGROUND OF INVENTION

This invention relates to finger actuated switches, and more particularly to method and apparatus for protecting circuitry connected to tactile switches from an electrostatic discharge into the switch.

A programmable CATV converter includes a control unit having keyboard switches with electrical contacts connected through an associated signal processes to an earth ground reference potential. The processor is responsive to a signal from the control unit for selecting a particular television channel and converting the associated composite television signal to a prescribed RF frequency band prior to application to a subscriber's television set. The converter may also include MOS integrated circuitry comprising a microprocessor that is connected to the switches and ground. The microprocessor may store the identity of a number of channels that are pre-selected for viewing. Such integrated circuitry is particularly sensitive to electrostatic charge and may be destroyed by an electrostatic discharge induced during activation of the control unit. In a table top control unit, a viewer presses his finger on a large plastic button to activate an individual switch element of a matrix switch and select a prescribed channel for viewing. Although the plastic buttons insulate associated switch contacts from an electrostatic charge stored by the viewer's body when his finger touches the button, it results in a large and bulky control unit. In a small hand-held calculator-style control unit with a tactile or touch-type keyboard, there is only a sheet of Mylar® separating the electrostatic charge on a finger from switch contacts. The tactile matrix switch of another hand-held control unit included a thin flexible Mylar® face plate, having switch contacts on the back side thereof centered in associated blocks defined by orthogonal grid lines. In this matrix switch, an electrically conductive neoprene gasket-type shield was bonded onto the face plate along the grid lines and connected to ground. This protection shield proved unsatisfactory in a cold-dry climate in which a large electrostatic charge may be built up and stored, an electrostatic charge on a finger arcing through the Mylar® face plate rather than to the adjacent shield. An object of this invention is the provision of an improved electrostatic-discharge protected tactile switch.

SUMMARY OF INVENTION

In accordance with this invention, an electrostatic-discharge protected switch that is caused to be in a switch closed condition by a human operator pressing his finger on the front of the switch comprises: a plurality of electrically conductive switch contact elements, at least some of which are electrically connected through external electrical circuitry to an earth ground reference potential, said switch contact elements being arranged within a prescribed area so that the switch is in a normally open condition and is in a switch closed condition when a finger is placed over the prescribed area and proximate the switch contact elements; a layer of electrically conductive material extending over the switch contact elements in the prescribed area; means for dielectrically insulating the conductive layer from the switch contact elements; and means for electrically connecting the conductive layer to ground, whereby an electrostatic discharge emanating from an operator's finger, that is at least close to the conductive layer and over the area of the switch contact elements, is isolated from the switch contact elements and carried to ground by said conductive layer for protecting electrical circuitry connected to the switch contact elements.

DESCRIPTION OF DRAWINGS

This invention will be more fully understood from the following detailed description of preferred embodiments thereof together with drawings in which.

DESCRIPTION OF PREFERRED EMBODIMENTS

Figure 1:
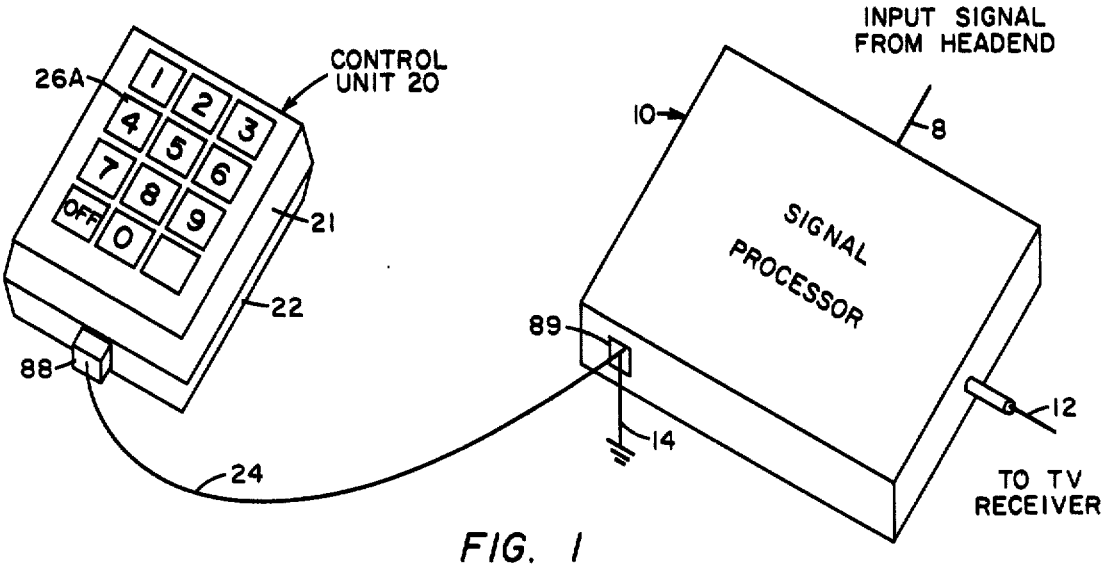
FIG. 1 is a block diagram of programmable CATV converter equipment embodying this invention.
Figure 2:
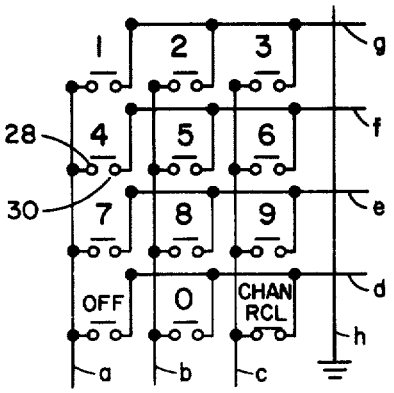
FIG. 2 is a schematic circuit diagram of a matrix switch in a control unit 20.

Referring now to FIG. 1, a programmable CATV converter for use at a subscriber location generally comprises a signal processor 10 and a hand-held control unit 20. The processor 10 is responsive to a control signal in cable 24 for converting a received composite television signal on the input line 8 from head-end equipment to a particular channel spectrum signal that is applied on line 12 to a television set for viewing. The control unit 20 is essentially a 12-position tactile matrix switch that may be held in the hand of a subscriber. A schematic representation of the matrix switch is shown in FIG. 2. The control unit also included MOS type integrated circuitry including a microprocessor that i sensitive to an electrostatic discharge. Switch contacts are electrically connected through the microprocessor, a wire of the cable 24 and line 14 to ground. The switch is activated by a subscriber pressing his finger on the front of a faceplate in a window 26A, for example, in the upper half 21 of a control unit case. This causes switch contact elements 28 and 30 in FIG. 2 to be electrically connected together as is described more fully hereinafter. The control unit case may be injection or vacuum molded out of a copolymer resin material such as high impact resistant ABS plastic. The upper case half 21 has a plurality of window type openings 26 extending through the top thereof. A plurality of heat-deformable rivet-type plastic posts or stakes 34 extend upward from the flat underside 36 of the case part 21. The posts 34 are orthogonal to the underside 36 and arranged in a prescribed pattern.

Figure 4:
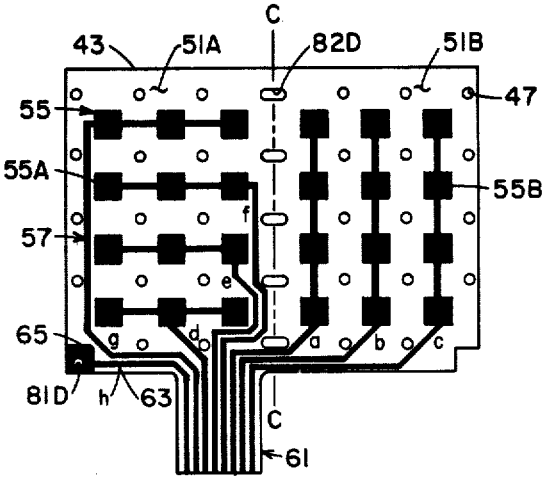
FIG. 4 is a plan view of a printed wiring board 51 of the 12-position keyboard assembly 41 in FIG. 3.
Figure 3:
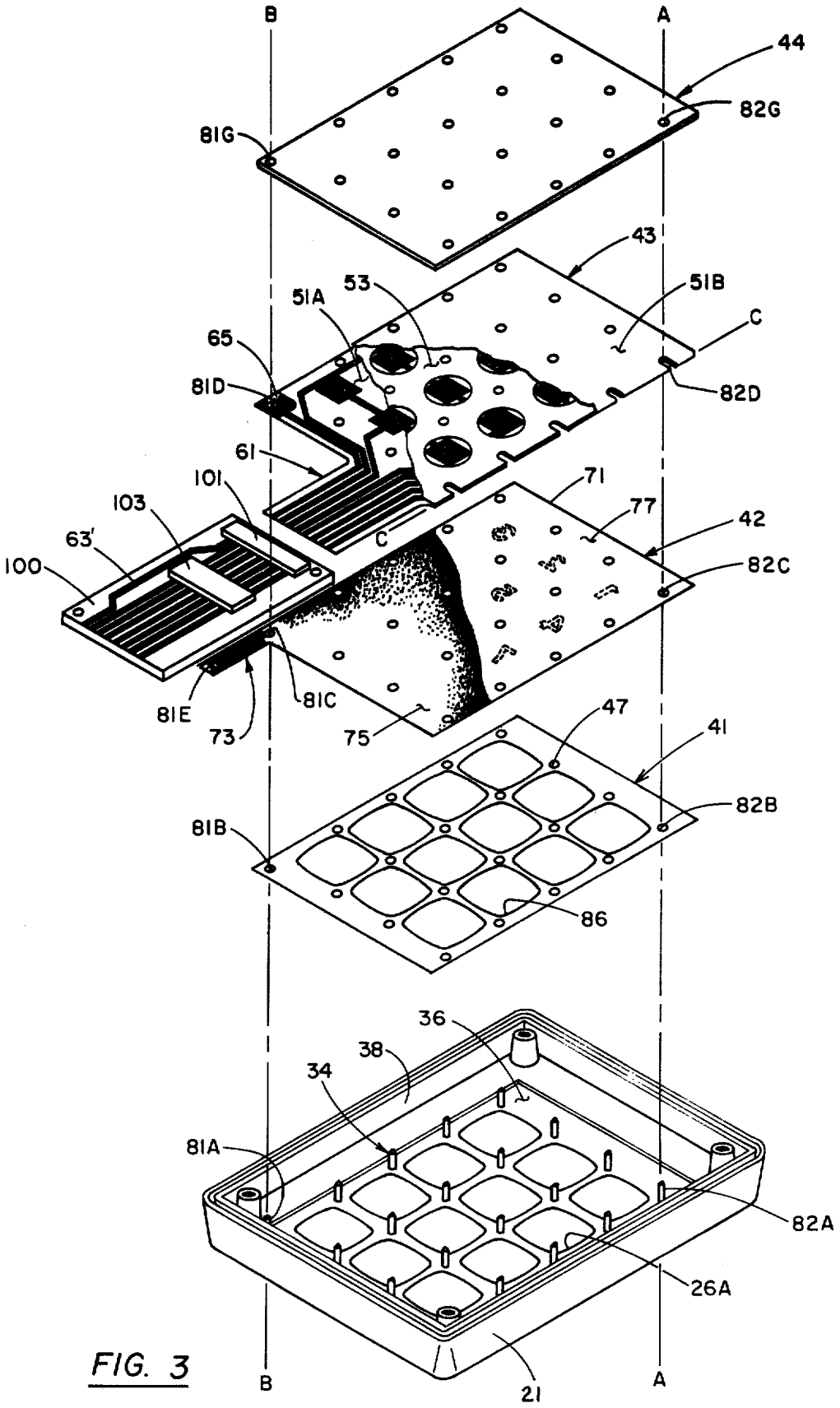
FIG. 3 is an exploded view of a tactile matrix switch embodying this invention with some parts thereof broken away for clarity of illustration, the top half 21 of the control unit case and switch parts being inverted from their orientation in FIG. 1.

The matrix switch comprises a mask 41, face plate 42, keyboard assembly 43, and base plate 44 that are stacked in that order over the underside 36 of the upper half 21 of the case. Each of the parts 41–44 has a plurality of alignment holes 47 punched therethrough in the same pattern and spacing as stakes 34. The keyboard assembly 43 is a product that is now available from Chromerics of Woburn, Mass. and comprises a printed wiring board 51 (see FIG. 4) and a dielectric spacer 53 (see FIG. 3). The printed wiring board 51 is essentially a flexible dielectric sheet that is divided in half along a center line C—C and has a plurality of electrically conductive pads 55 and electrically conductive traces 57 formed on one board surface of the dielectric sheet by conventional printing techniques. The pads are located on the dielectric sheet so that associated ones thereof, such as pads 55A and 55B, overlap when the two halves of the dielectric sheet 51 are folded from right to left in FIG. 4 about the line C—C. The dielectric sheet 51 may be a 0.005 inch thick sheet of Mylar ®. Selected ones of the pads 55 are interconnected by conductive traces that are extended onto an ear 61. A trace 63 there is also connected to a grounding pad 65 in the lower left corner of the left half of the circuit board. The lower right corner of the other half of the dielectric sheet 51 is also cut away so that the pad 65 is exposed when the sheet 51 is folded over along the line C—C. A thin dielectric spacer 53 that is approximately the same size as the left side 51A of the circuit board is located between the folded over sides thereof for insulating conductor pads on opposite sides from each other (see FIG. 3). The spacer 53 may be a 0.005 inch thick sheet of Mylar ® having circular holes over associated conductive pads as is shown in FIG. 3. By way of example, the pads may measure 0.4 inch by 0.4 inch and the holes have a diameter of 0.5 inch.

The face plate 42 is a thin flexible dielectric sheet 71 of 0.003 inch thick Mylar ®, for example, having a tab 73 adjacent one corner thereof. The face plate has a white front surface with black overlettering in the area of the windows. In accordance with this invention, a layer 75 of material that is a good conductor of electrical charge is preferably formed on the back side 77 of the dielectric sheet 71 and tab 73 so as to extend over the whole surface thereof. The conductive layer 75 may be formed on the back of the face plate by a number of conventional techniques. By way of example, the layer 75 may be a thin sheet of copper or other conductive metal that is pressure bonded or glued onto the face plate. Or it may be formed by evaporating metal onto the surface 77. Alternatively, the conductive layer may be an electrically conductive metallic ink that is printed or silk screened onto the surface 77 of the face plate. And in a cost-reduced matrix switch, the conductive layer 75 preferably comprises an electrically conductive resistive ink having a resistivity of less than 50 k ohms per square. The ink may also be a carbon compounded printer's ink such as EL-796 which is available from Advance Process Supply Co., of Chicago, Ill., and has a resistivity in the order of 50 k ohms per square. The resistive ink is preferably silk screened onto the back of the face plate for causing the layer 75 to have a thickness providing a lower resistivity in the order of 20 k ohms per square. Alternatively, the resistive ink may be printed onto the back of the face plate.

The mask 41 is a pliable dielectric material such as rubber or plastic film that has holes 86 therethrough corresponding to the window openings 26 in the front of the case part 21. It also has mastic material on both of the broad sides thereof that are covered with a protective tape. The base plate 44 is a rigid, flat plastic member having alignment holes therethrough in the same pattern as posts in the recess 38 in the upper half of the case.

Figure 5:
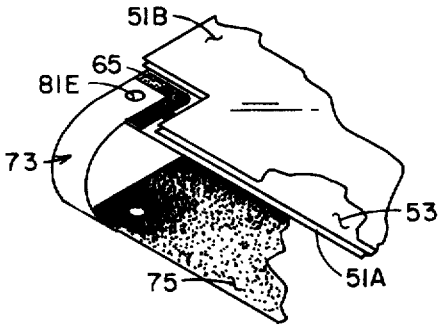
FIG. 5 is an exploded view of an enlarged portion of the switch in FIG. 3, with the grounding tab 73 folded over the ground pad 65 on the printed wiring board 51.

The matrix switch in FIG. 3 is assembled by removing the protective tape from one broad surface of the mask 41 and locating alignment holes such as holes 81B and 82B over associated posts 81A and 82A and pressing on the other side of the mask to bond it to the underside 36 of the case part 21. After exposing the mastic on the other broad side of the mask, alignment holes 81C and 82C of the face plate are located over the posts 81A and 82A, pressure being carefully applied to the conductive surface of the face plate in order to bond the latter to the mask and provide a moisture seal over the front of the case. This seals liquids, such as beer that is spilled over the control unit by a subscriber-viewer, out of the matrix switch for protecting it and other circuitry in the control unit. The dielectric spacer 53 is then located between the two sides 51A and 51B of the folded-over dielectric sheet 51, with the grounding pad 65 exposed. This provides a keyboard assembly 43 having an alignment hole 81D and slot 82D that are positioned over the posts 81A and 82A. The tab 73 on the face plate is then folded over, as is shown in FIG. 5, and the post 81A located in the alignment hole 81E so as to cause the conductive surface on tab 73 to contact conductive pad 65 on the left side 51A of the wiring board. After locating alignment holes 81G and 82G of the base plate over the posts 81A and 82A, a compression force is exerted on the base plate for forcing the parts 41–44 together prior to selectively heating posts 34 and beading them over against the base plate for holding the planar switch parts 41–44 and the case together. This electrically connects the conductive layer 75 on the back of the face plate to pad 65 and to the printed wire 63 on the extension of the wiring board. The tape cable 61 on the wiring board is then plugged into an appropriate commercially available connector 101 on a printed wiring board 100 in FIG. 3. The circuit board 100 carries the connector and an electrical circuit 103 including a microprocessor that is an MOS integrated circuit. The circuit board 100 is attached to the inside of the lower half of the case with screws. Finally, conductive lines on circuit board 100 are connected to pins of a plug 88 in an edge of the lower half of the control unit prior to sealing the two halves of the case together.

In operation, a cable 24 is attached to the processor 10 and the plug 88 in the control unit for electrically connecting the pad 65 and microprocessor to ground and to electrical circuitry in the processor 10. The tactile matrix switch in the control unit is actuated by a subscriber pressing his finger on the exposed surface of the face plate 42 in a window 26A, for example, for flexing the face plate and keyboard part 51A for bending the latter into the associated opening in spacer 53 so as to bring pads 55A and 55B into electrical contact and closing the switch element associated with the numeral 4. When an electrostatic charge stored by the subscriber's body exceeds the barrier potential established by the Mylar ® faceplate, it is discharged from his finger into the conductive surface 75 on the back of the face plate, and through pad 65, printed wire 63, a line 63' on circuit board 100, a wire of cable 24, and line 14 to ground for protecting the microprocessor. In this manner, an electrostatic discharge from a subscriber's finger is isolated from switch contacts and the microprocessor.

Figure 6:
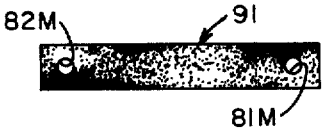
FIG. 6 is a plan view of the conductive side of a ground strap 91 for an alternate embodiment of this invention.

Although this invention is disclosed in relation to preferred embodiments thereof, variations and modifications thereof will occur to those skilled in the art. By way of example, the conductive surface 75 may be formed on the front of the face plate 42 with a black carbon ink, for example, and desired lettering formed in white thereon. This conductive surface is grounded by cutting the tab 73 off of the face plate and locating the hole 81M in a grounding strap 91 (see FIG. 6) over the post 81A, with the conductive surface thereof facing upward in FIG. 3, prior to the face plate and keyboard assembly being placed over stakes 34. The other alignment hole 82M in the ground strap 91 is then placed over the post 81A as is generally indicated in FIG. 5 prior to locating the base plate 44 over the stakes for insuring a good electrical connection between the pad 65 and the conductive front surface of the face plate through ground strap 91. Also, a shoulder may be formed on the underside of the base plate 44 adjacent the alignment hole 81G for insuring a firm pressure contact between tab 73 and the pad 65 on the wiring board. Additionally, it is not necessary for the conductive layer 75 to be attached to or formed on the face plate. The conductive layer may be formed on the underside of the half 51A of the wiring board in FIG. 4. Alternatively, the conductive layer may be a thin sheet of metal foil such as aluminum or copper that is placed between the face plate 42 and the keyboard assembly 43 in FIG. 3. The scope of this invention is therefore to be determined from the attached claims rather than the detailed descriptions of preferred embodiments thereof.

What is claimed is:

1. In a pressure actuated matrix switch means including a plurality of switch contact elements, with at least some contacts being electrically connected to ground through external circuitry, the switch contacts being arranged in pairs in a prescribed area so that each individual switch element is normally open and is closed by a human operator pressing on the prescribed area and proximate a switch contact, the method of protecting the electrical circuitry from discharge of an electrostatic charge that may be carried by the operator's body and finger comprising the steps of:

first locating a substantially continuous electrically conductive flexible member over the full breadth of the prescribed area, and between the switch contact elements and the operator;

dielectrically insulating the conductive member from the switch contact elements over the prescribed area; and directly electrically connecting the conductive member to ground, an electrostatic discharge emanating from a human body part, that is at least close to the conductive member and over the area of switch contact elements, being isolated from the switch contact elements and carried to ground by the conductive member for protecting the electrical circuitry.

2. The method according to claim 1 including the step of second locating at least some switch contact elements on one broad side of a flexible sheet of dielectric material that continuously extends over the full breadth of the prescribed area, and wherein said first locating step and said insulating step comprise the step of third locating on the other broad side of the dielectric sheet the conductive member, which is an electrically conductive film type layer of material having substantially zero resistivity and continuously extending over an area that is greater than the full breadth of the prescribed area.

3. An electrostatic-discharge protected pressure actuated matrix switch including a plurality of individual switch elements that are spaced apart so as to be generally located in a common plane in a matrix configuration, said matrix switch comprising:

a pair of switch contact members associated with each of said individual switch elements that are in a prescribed area; at least some of said switch contact members being electrically connected through external electrical circuitry to a ground reference potential;

a first planar dielectric member that is flexible, that extends over the full breadth of the prescribed area, and which has one contact member of each switch element on one broad side thereof that is substantially parallel to the common plane;

first means supporting an other one of said contact members of each switch element facing and spaced a prescribed distance, in a prescribed direction orthogonal to the common plane, from an associated one contact member of the same switch element such that a pressure force directed in the prescribed direction and translated to a particular one contact member on said first dielectric member causes that particular contact member and at least an associated contact member to come into physical and electrical contact for closing the switch element;

second means which is a flexible planar electrically conductive member located proximate to the other side of said first dielectric member and continuously extending over the breadth of said first dielectric member having contact members on it; and third means for directly electrically connecting said second means to ground, the body of a human operator supporting an electrostatic charge, and brought adjacent said second means for actuating a particular switch element, being discharged to ground through said second means for protecting the electrical circuitry from the electrostatic discharge.

4. The matrix switch according to claim 3 wherein said second means comprises a layer of electrically conductive ink having a very high value of conductivity and formed on a broad side of a flexible dielectric member that may be the same as said first dielectric member.

5. An electrostatic-discharge protected pressure actuated matrix which including a plurality of individual switch elements that are spaced apart in a prescribed area so as to be generally located in a common plane in a matrix configuration, said matrix switch comprising:

a pair of switch contact members associated with each of said individual switch elements in the prescribed area; at least some of said switch contact members being electrically connected through external electrical circuitry to a ground reference potential;

a first planar dielectric member that is flexible, that extends over the full breadth of the prescribed area, and which has one contact member of each switch element on one broad side thereof that is substantially parallel to the common plane;

first means supporting an other one of said contact members of each switch element facing and spaced a prescribed distance, in a prescribed direction orthogonal to the common plane, from an associated one contact member of the same switch element such that a pressure force directed in the prescribed direction and translated to a particular one contact member on said first dielectric member causes that particular contact member and at least an associated contact member to come into physical and electrical contact for closing the switch element;

second means comprising a layer of resistive ink located proximate the other side of said first dielectric member and continuously extending over the full breadth of said first dielectric member that has switch contact members thereon; and third means for directly electrically connecting said second means to ground, the body of a human operator supporting an electrostatic charge, and brought adjacent said second means for actuating a particular switch element, being discharged to ground through said second means for protecting the electrical circuitry from the electrostatic discharge.

6. The matrix switch according to claim 3 or 5 comprising a second planar flexible dielectric member, that extends continuously over the full breadth of the prescribed area, that is located between said second means and a human operator, and which has one of said flexible planar electrically conductive member and said layer of resistive ink, which comprise said second means, formed on one broad side thereof over the prescribed area.

* * * * *